US011788412B2

(12) United States Patent
Mapp et al.

(10) Patent No.: US 11,788,412 B2
(45) Date of Patent: Oct. 17, 2023

(54) RECOVERING CONVEYOR SYSTEMS AND CONTINUOUS MINERS FROM MINED PLUNGE TUNNELS IN UNDERGROUND MINES

(71) Applicant: Underground Extraction Technologies Pty Ltd, Brisbane (AU)

(72) Inventors: Michael Mapp, Brisbane (AU); Brian MacDonald, Brisbane (AU)

(73) Assignee: UNDERGROUND EXTRACTION TECHNOLOGIES PTY LTD., Brisbane (AU)

( * ) Notice: Subject to any disclaimer, the term of this patent is extended or adjusted under 35 U.S.C. 154(b) by 0 days.

(21) Appl. No.: 17/259,810

(22) PCT Filed: Jul. 19, 2019

(86) PCT No.: PCT/AU2019/050756
§ 371 (c)(1),
(2) Date: Jan. 12, 2021

(87) PCT Pub. No.: WO2020/014747
PCT Pub. Date: Jan. 23, 2020

(65) Prior Publication Data

US 2021/0164349 A1 Jun. 3, 2021

(30) Foreign Application Priority Data

Jul. 19, 2018 (AU) ..... 2018902621

(51) Int. Cl.
*E21F 13/00* (2006.01)
*E21C 27/24* (2006.01)
(Continued)

(52) U.S. Cl.
CPC ..... *E21F 13/006* (2013.01); *E21C 27/24* (2013.01); *E21C 35/08* (2013.01); *E21F 13/083* (2013.01)

(58) Field of Classification Search
CPC ..... E21F 13/006; E21F 13/083; E21F 11/00; E21F 13/00; E21F 13/08; E21C 33/00;
(Continued)

(56) References Cited

U.S. PATENT DOCUMENTS 2,674,364 A * 4/1954 Cartlidge ..... E21F 13/02 198/303
5,031,752 A * 7/1991 Rostowski ..... B65G 41/008 198/735.6
(Continued)

FOREIGN PATENT DOCUMENTS

AU 2009230812 A1 2/2011
CN 1429310 A 7/2003
(Continued)

OTHER PUBLICATIONS

China National Intellectual Property Administration, Office Action, dated Dec. 20, 2022.

*Primary Examiner* — Janine M Kreck
*Assistant Examiner* — Michael A Goodwin
(74) *Attorney, Agent, or Firm* — DeLio Peterson & Curcio LLC; Brian G. Schlosser

(57) ABSTRACT

The present invention relates to a system for recovering a continuous miner arrangement from a tunnel. The system includes a coupler for coupling the continuous miner arrangement to a pulling apparatus. The pulling apparatus pulls the continuous miner arrangement from the tunnel. Advantageously, the pulling apparatus may pull the continuous miner arrangement from the tunnel, either fully or
(Continued)

partially until the continuous miner arrangement may once again retract from the tunnel under its own power.

17 Claims, 3 Drawing Sheets

(51) Int. Cl.
*E21F 13/08* (2006.01)
*E21C 35/08* (2006.01)

(58) Field of Classification Search
CPC ..... E21C 35/16; E21C 27/24; E21C 35/08; E21C 35/24
USPC ..... 254/134.3 FT, 134.3 R
See application file for complete search history.

(56) References Cited

U.S. PATENT DOCUMENTS 5,098,065 A * 3/1992 Beletich ..... E21F 13/006 254/1
5,112,111 A * 5/1992 Addington ..... E21C 27/24 299/18
5,609,397 A * 3/1997 Marshall ..... E21C 25/68 105/3
5,992,941 A * 11/1999 Delli-Gatti, Jr. ..... B65G 41/008 198/303
6,109,699 A 8/2000 Mraz
7,594,702 B2 9/2009 Lowery
2008/0142767 A1* 6/2008 Antoline ..... E21F 13/083 254/266
2013/0049435 A1 2/2013 Graham
2015/0001911 A1* 1/2015 Whitley ..... E21F 17/00 299/10
2017/0166022 A1* 6/2017 Springer ..... B60D 1/565
2017/0198581 A1* 7/2017 Denver ..... E21F 13/083

FOREIGN PATENT DOCUMENTS

CN 1455842 A 11/2003
CN 102119260 A 7/2011
GB 1524635 9/1978
WO WO-2016044886 A1 * 3/2016 ..... E21B 7/046

* cited by examiner

RECOVERING CONVEYOR SYSTEMS AND CONTINUOUS MINERS FROM MINED PLUNGE TUNNELS IN UNDERGROUND MINES

TECHNICAL FIELD

The present invention generally relates to a system for recovering a continuous miner arrangement from a tunnel. The present invention has particular, although not exclusive application to underground coal mining.

BACKGROUND

The reference to any prior art in this specification is not, and should not be taken as an acknowledgement or any form of suggestion that the prior art forms part of the common general knowledge.

Underground coal mining traditionally involves the formation of series of roadways (i.e. mined out tunnels) of varying layout to suit the reserve of coal being mined. Roadways are supported, in the roof strata and/or the sidewalls (called ribs), to enable the safe passage of personnel to enter and exit the mine. The supported roadways also stay safely open for the passage of equipment, the installation of services (compressed air, water, electrical power infrastructure), and the carriage of mine ventilation air throughout the mine.

A series of unmined coal 'blocks' (or unmined coal reserve areas) are located between the roadways, and the roadways provide access to these unmined coal blocks. A series of conveyors transport the coal mined from the blocks away from the mining areas and to the surface of the mine.

AU 2016210621 discloses a system in which a continuous miner forms dead end plunge cuts from gate roads to mine the blocks. The miner is coupled to a flexible conveyor system, including serial conveyor modules, which carries the coal away from the continuous miner to fixed conveyors elsewhere in the mine. The flexible conveyor system can continuously transport coal either in a straight line or around corners owing to its flexibility.

There are varying types and styles of flexible conveyor systems, but they all have the features of enabling the continuous transport of coal along their length. The flexible conveyor systems comprise a number of inter-connected module sections of varying length and connectivity, and are of a form that can flexibly transport coal around varying-angled corners of the connected roadways in the areas of the underground mine plan layout. The flexible conveyor systems extend to the active mining face where the coal is being mined by the continuous miner.

There are many circumstances where the continuous miner and/or the flexible conveying system is unable to move under their own normal traction devices to extricate the equipment out of the partially or fully mined plunge tunnels. Such circumstances, which would give rise to the need for the recovery of equipment from the partially or a fully mined plunge, are as follows:

From a rock strata failure in the roof—i.e. from a 'Roof fall' where rock from the roof of the plunge cut falls onto the continuous miner or the flexible conveying system such that it cannot move itself out of the plunge under its normal powered traction systems;

From a rock strata failure in the side wall of the plunge—i.e. from a 'Rib fall' where rock from the sidewall (or 'Rib') of the plunge falls onto the continuous miner or the conveying system such that it cannot move itself out of the plunge under its normal powered traction systems;

From an electrical power failure to the continuous miner and/or to the conveying system which could be caused, for example, from a power 'trip' in a circuit breaker or damage to a power cable—there are other causes that could be cited; and From an event that causes a hydraulic system failure or leak under various circumstances.

The preferred embodiment provides a system for recovering a continuous miner arrangement under such circumstances.

SUMMARY OF THE INVENTION

According to one aspect of the present invention, there is provided a system for recovering a continuous miner arrangement from a tunnel, the system including:

a coupler for coupling the continuous miner arrangement to a pulling apparatus; and the pulling apparatus for pulling the continuous miner arrangement from the tunnel.

Advantageously, the pulling apparatus may pull the continuous miner arrangement from the tunnel, either fully or partially until the continuous miner arrangement may once again retract from the tunnel under its own power.

The system may further include one or more guides for guiding the continuous miner arrangement being pulled. The guides may include rollers.

The pulling apparatus may include a winch with a line terminating in the coupler. The pulling apparatus may be fixed or static.

The system may further include a support assembly for supporting the pulling apparatus. The support assembly may include a pair of lateral supports located on either side of the tunnel. Each lateral support may extend across a gate road from which the tunnel extends. Each lateral support may be triangular. The support assembly may further include a base support located opposite the tunnel.

The pulling apparatus may include at least one ram. The ram may be coupled with the coupler to the centre of the continuous miner arrangement. Alternatively, the at least one ram may include a pair of rams for mounting to either side of the continuous miner arrangement. The ram may be a hydraulic ram.

The continuous miner arrangement may include a continuous miner and a flexible conveyor system coupled to the continuous miner.

According to another aspect of the present invention, there is provided a method for recovering a continuous miner arrangement from a tunnel, the method involving:

coupling the continuous miner arrangement to a pulling apparatus; and pulling the continuous miner arrangement from the tunnel with the pulling apparatus.

The method may involve providing guides to guide the continuous miner arrangement along a path.

The method may involve decoupling one or more conveyor modules from the continuous miner arrangement, prior to pulling. The method may involve pulling and then removing the rearmost conveyor of the continuous miner arrangement, before repeating so that the continuous miner arrangement is serially removed.

The method may involve assembling a support assembly for supporting the pulling apparatus.

According to another aspect of the present invention, there is provided a system for recovering a mining equipment from a tunnel, the system including:

a coupler for coupling the mining equipment to a pulling apparatus; and the pulling apparatus for pulling the mining equipment from the tunnel.

Any of the features described herein can be combined in any combination with any one or more of the other features described herein within the scope of the invention.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
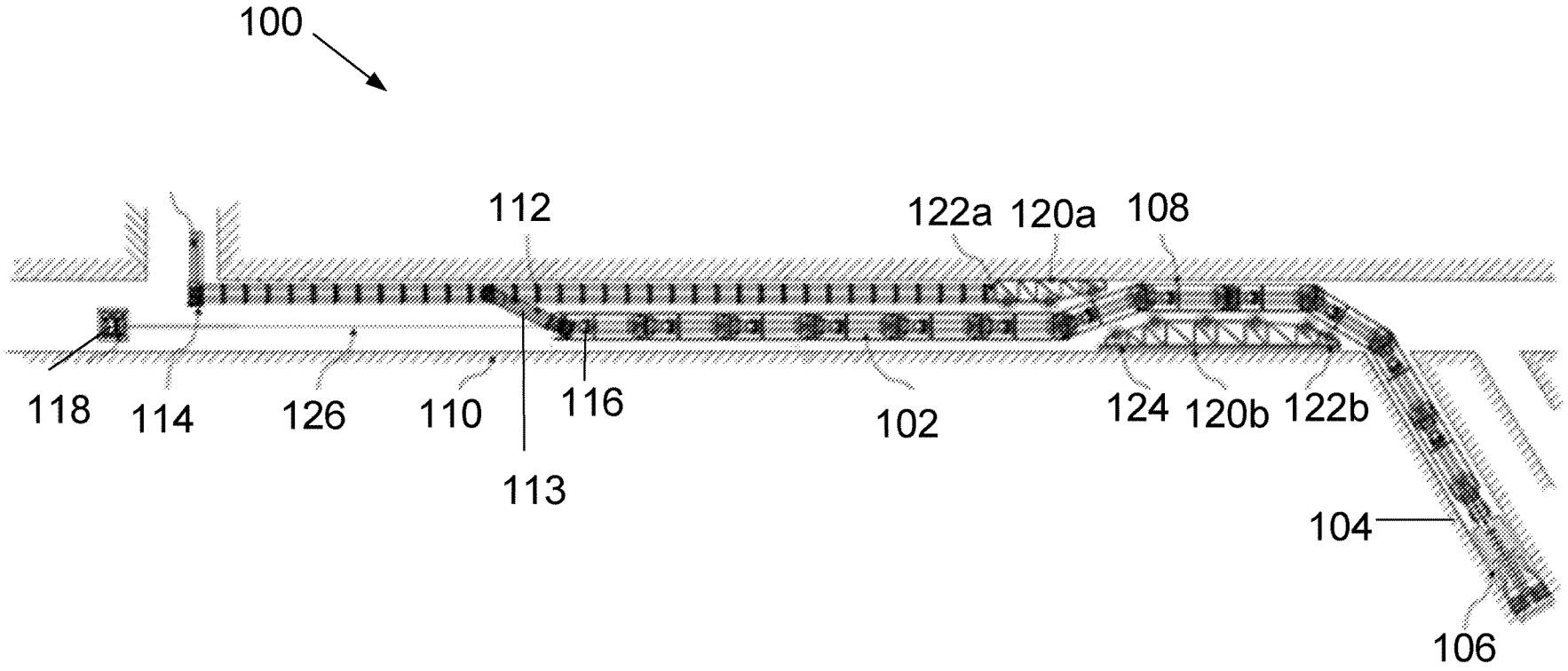
FIG. 1 is a schematic plan view of a guided pathway recovery system for recovering a continuous miner arrangement in accordance with a first embodiment of the present invention.

According to a first embodiment of the present invention, there is provided a guided pathway recovery system 100 shown in FIG. 1 for recovering a continuous miner arrangement 102 from a dead-end plunge tunnel 104 which it is forming. The continuous miner arrangement 102 includes an unmanned continuous miner 106 and a flexible conveyor system 108 coupled to the continuous miner 106.

The system 100 also includes a gate road 110 from which the plunge tunnel 104 is formed. A static conveyor 112 is located in the plunge tunnel 104 and can be loaded with coal from the flexible conveyor system 108 using a bridge 113. Coal is then unloaded at the terminus 114.

The system 100 includes a mechanical coupler 116, including a hook or shackle for example, for coupling the continuous miner arrangement to a pulling apparatus 118. The pulling apparatus 118 pulls the stuck continuous miner arrangement 102 from the tunnel 104.

Advantageously, the pulling apparatus 118 can pull and extricate the continuous miner arrangement 102 from the tunnel 104, either fully or partially until the continuous miner arrangement 102 can once again retract from the tunnel 104 under its own power.

The system 100 further includes opposed guides 120*a*, 120*b* for guiding the continuous miner arrangement 102 being pulled. Each guide 120 includes a truss support assembly 122, and a series of rollers 124 against which the arrangement 102 can engage during pulling.

The pulling apparatus 118 typically includes a winch with a line 126 terminating in the coupler. The pulling apparatus 118 forcibly pulls the conveyor equipment 108 and the continuous miner 106 backwards to withdraw it from the mined plunge tunnel 104.

In the circumstance where the continuous miner arrangement 102 cannot withdraw for reasons unrelated to the arrangement 102 being 'blocked' in the plunge tunnel 104, then the force required to withdraw the arrangement 102 is much less than where the equipment is 'blocked'. Such forces in this circumstance need only be capable of moving the arrangement 102 itself and overcoming its inertia of motion and the rolling or skidding resistance that would apply.

The recovery system 100 deploys a series of structures and 'guides' 120 which control the path that the withdrawing conveyor 108 and continuous miner 106 travel through, and a cable 126 and pulling force that 'pull' the equipment out of the mined plunge tunnel 104 until the equipment is fully withdrawn. In this case, the conveyor system 108 or other equipment need not be disconnected in order to recover the arrangement 102—it is simply 'pulled' out of the plunge tunnel 104 and the 'guide' structures 120 ensure that the arrangement 102 travels through the desired travel path that it needs to travel through in order to be fully back into the roadway 110 of the underground mine.

A Guided Pathway Recovery method for recovering the continuous miner arrangement 102 is now briefly described.

Where the arrangement 102 is not 'blocked' in the mined plunge tunnel 104, but rather it cannot operate due to some electical power of other systems failure (i.e. hydraulic or communications etc), the opposed guides 120*a*, 120*b* are installed. A series of support structures 122 are moved into place and erected or assembled to form an integrated series of structures 122 on either side of the roadway in the vacinity of the plunge tunnel 104 where the arrangement 102 cannot withdraw by its normal operating capability.

The structures 122 are 'pinned' or engaged into the ground or the sidewalls of the roadway 110 by ground or rock bolting practices, such that the structures 122 cannot be moved and are rigidly fixed in position.

A series of rollers or rotating wheels 124, or low surface friction fixed materials, are installed into the assembled/erected structures 122. The rollers 124 allow the side rails of the arrangement 102 to move past the fixed structures 122 and cause the arrangement 102 to follow a pre-designated travel pathway by virtue of the configuration of the assembled structures 122.

The attachment of the coupler 116 to the end of the last conveyor module enables the pulling apparatus 118 to apply a pulling force to the cable 126. The pulling apparatus 118 can include a winching device (suitably fixed in position in order to apply the force required) or it could include a large item of undergound mining equipment with suitable motive pulling force (i.e. a tracked dozer or a large rubber tyred loader).

The pulling apparatus 118 pulls the arrangement 102 out of the plunge tunnel 104 through the use of the cable 126 whereby the whole arrangement 102 travels through the pre-designated travel pathway to exit the plunge tunnel 104.

Figure 2:
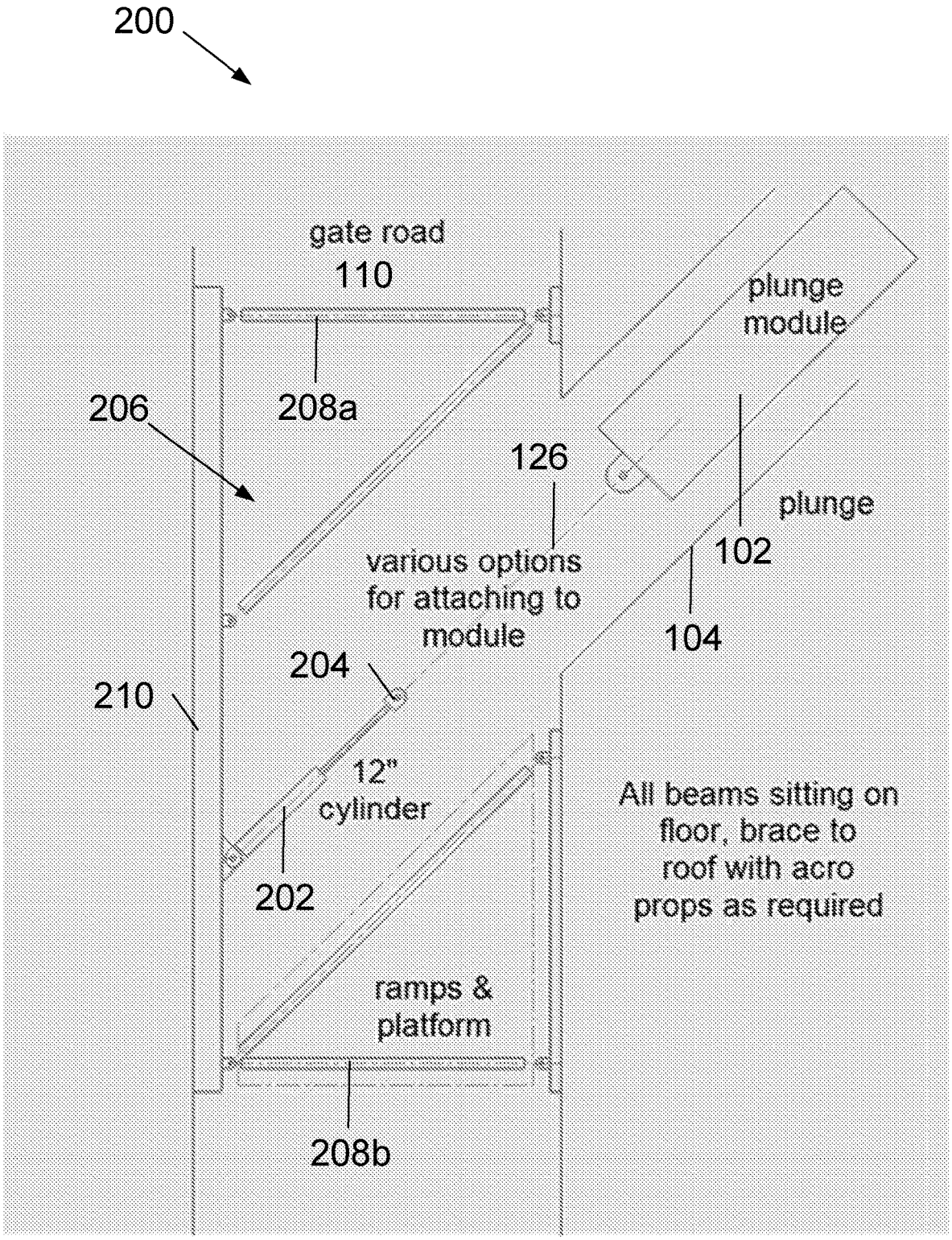
FIG. 2 is a schematic plan view of a hydraulic extraction recovery system for recovering a continuous miner arrangement in accordance with a second embodiment of the present invention.

According to a second embodiment of the present invention, there is provided a hydraulic extraction recovery system 200 shown in FIG. 2. The system 200 is used in the circumstances where the continuous miner arrangement 102 cannot withdraw because it is either partially or wholly 'blocked' in the plunge tunnel 104 because there has been a 'roof' fall event or a sidewall 'rib' failure event, then the loads required to withdraw the equipment are appreciably larger. This increased load is due to the need to forcably 'pull' the arrangement 102 through, around, under or over the rock strata that has failed and which is consuming some of the plunge tunnel space and 'blocking' the equipment from moving.

The pulling apparatus 202 includes at least one hydraulic ram which is coupled with the coupler 204 to the centre of the continuous miner arrangement 102. The system 200 includes a support assembly 206 for supporting the pulling apparatus 202. The support assembly 206 includes a pair of triangular lateral supports 208*a*, 208*b* located on either side of the plunge tunnel 104. Each lateral support 208 extends across and fills the gate road 110 from which the plunge tunnel 102 extends. The support assembly 206 further includes a base support 210 located opposite the tunnel.

The support assembly 206 includes a connected series of structural members (i.e. steel beams and props/supports). The recovery method involves serially disconnecting each successive conveyor module (or segment) along the length of the conveyor 108 from the rear of the continuous miner arrangement 102. The ram applies the hydraulic force through one or more connecting points along the length of each individual conveyor unit (or segment)—unit the arrangement 102 is 'free' of the blockage which is preventing it from being withdrawn, or until all of the arrangement 102 is removed from the mined plunge tunnel 102.

A hydraulic extraction recovery method is now briefly described, where the arrangement 102 in the plunge tunnel 104 is 'blocked' from moving at all owing to some form of strata failure event (either 'roof' or sidewall 'rib'). Any conveyor modules in the roadway 110 are first decoupled and removed.

A large specially configured 'load spreading beam' 210 is installed on the opposite side of the roadway 110 from that of the entry to the plunge tunnel 104 where the arrangement 102 is 'stuck'. The installation of the beam 210 is such that it is specifically positioned in order that a hydraulic 'pulling' force can be applied longitudinally and parallel along the centre-line axis of the plunge tunnel 104 where the arrangement 102 is 'stuck'.

Next, installation of the lateral supports 208 is undertaken including associated specially configured series of supporting props/members and other associated supporting structures in and across the roadway 110. The supports 208 extend to the opposite side of the roadway 110 from the large load spreading beam 210 in order to provide a suitable network of 'bracing' structures against which the forces can be sustained in order to forcibly withdraw the arrangement 102 from the plunge tunnel 104.

The load spreading beam 210 and the supporting braces/structures are fixed in place using ground or rock bolting techniques.

The hydraulic ram 202 is attached to the load spreading beam 210 and is also connected to a suitable sized hydraulic power pack, for the purposes of applying a pulling force to the arrangement 102 'stuck' in the plunge tunnel 104.

By connecting the hydraulic ram 202 to designated attachment points on each conveyor unit/segment along the length of the conveyor system (by the use of a suitable coupler 204 including cables, chains, wire, ropes 126), and by operating the hydraulic ram 202 through its designated travel distance, the ram can be cycled in and out with each cycle applying a 'pulling force' on the arrangement 102 such that the arrangement 102 is partially withdrawn from the plunge tunnel with each hydraulic stroke, and between each cycle the ram being connected to the next attachment point such that with each cycle the whole length of the arrangement 102 is withdrawn from the plunge tunnel 104.

When each rear conveyor unit/segment has exited the plunge tunnel 104, the unit is decoupled and relocated/moved away from the recovery work area at the mouth of the plunge tunnel 104 and the next rear conveyor unit/segment is connected to the hydraulic ram 202 in order for that next successive unit/segment to be pulled and withdrawn from the plunge tunnel 104.

The foregoing process continues until all of the arrangement 102 has been withdrawn from the plunge tunnel 104. The recovery system 200 is then removed once the arrangement 102 has been withdrawn and the mining system operated as per normal.

Figure 3:
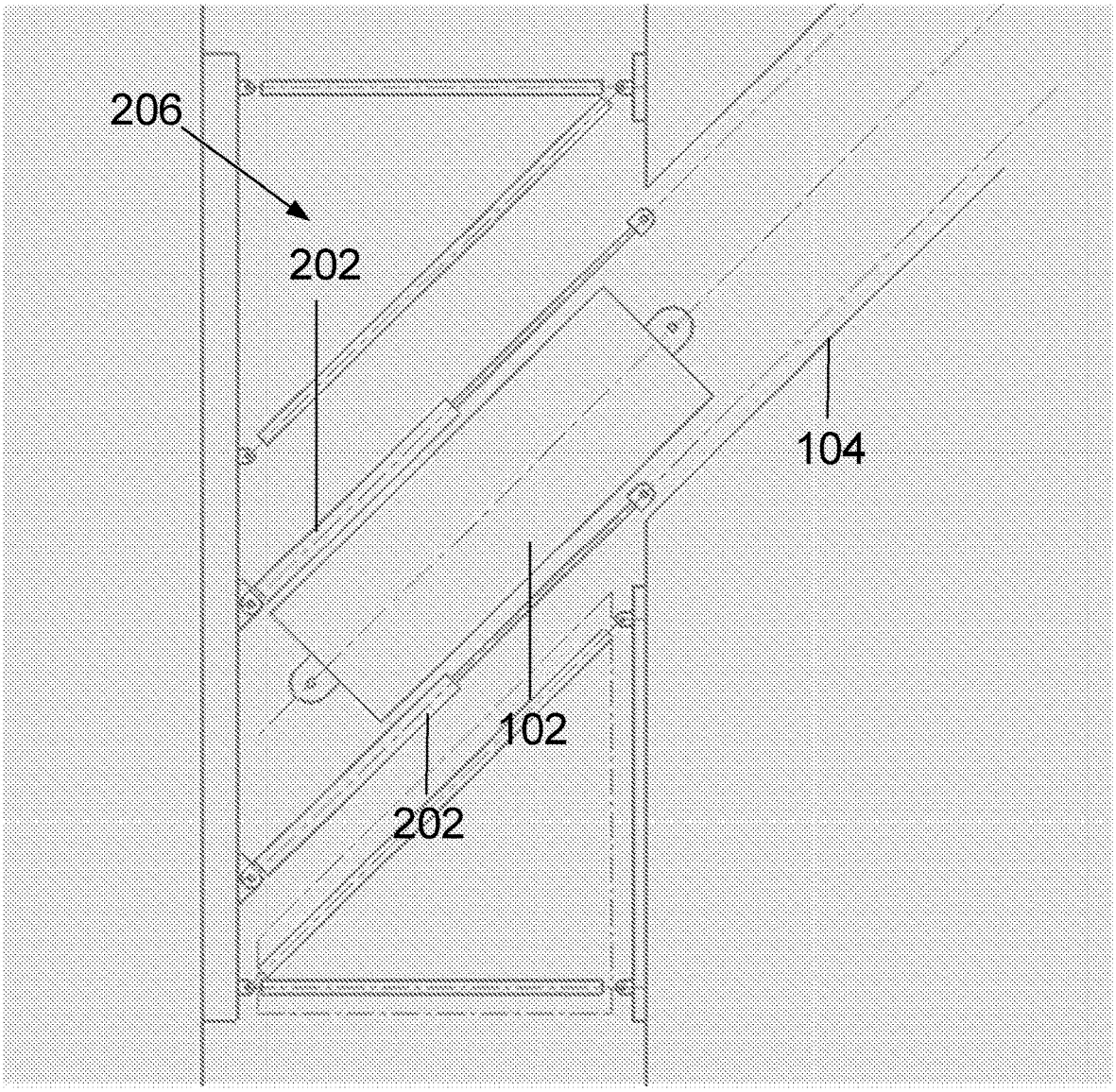
FIG. 3 is a schematic plan view of another hydraulic extraction recovery system for recovering a continuous miner arrangement in accordance with a third embodiment of the present invention.

FIG. 3 shows an alternative configuration where a pair of rams 202 are mounted to either side of the continuous miner arrangement 102 for increased pulling force.

A person skilled in the art will appreciate that many embodiments and variations can be made without departing from the ambit of the present invention.

In compliance with the statute, the invention has been described in language more or less specific to structural or methodical features. It is to be understood that the invention is not limited to specific features shown or described since the means herein described comprises preferred forms of putting the invention into effect.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The invention claimed is:

1. A system for recovering a stuck continuous miner arrangement from an elongate plunge tunnel extending in a first direction, the plunge tunnel formed from a gate road extending in a second direction, the continuous miner arrangement including a continuous miner and a flexible conveyor system with articulating conveyor modules coupled to the continuous miner, the articulating conveyor modules extending in the first direction and the second direction when forming the plunge tunnel, the system including:

a coupler for coupling the stuck continuous miner arrangement to a pulling apparatus; and the pulling apparatus for retracting to pull the flexible conveyor system of the stuck continuous miner arrangement from the plunge tunnel, either fully or partially, until the continuous miner arrangement can once again retract from the plunge tunnel under its own power, the pulling apparatus including at least one ram coupled to a wall of the gate road and which retracts to recover the stuck continuous miner arrangement.

2. A system as claimed in claim 1, further including one or more guides extending along the second direction for guiding the continuous miner arrangement being pulled.

3. A system as claimed in claim 2, wherein the guides include rollers.

4. A system as claimed in claim 1, wherein the pulling apparatus includes a winch with a retracting line terminating in the coupler, and for pulling the articulating conveyor modules in the first direction and the second direction.

5. A system as claimed in claim 1, wherein the pulling apparatus is fixed or static, and located outside the plunge tunnel and extends in the second direction.

6. A system as claimed in claim 1, further including a support assembly, located outside the plunge tunnel, for supporting the pulling apparatus.

7. A system as claimed in claim 6, wherein the support assembly includes a pair of lateral supports located on either side of an entrance to the plunge tunnel, and extending in a third direction perpendicular to the second direction.

8. A system as claimed in claim 7, wherein each lateral support extends fully across the gate road from which the plunge tunnel extends.

9. A system as claimed in claim 7, wherein each lateral support is triangular and wall mounted to the gate road.

10. A system as claimed in claim 6, wherein the support assembly includes a base support located opposite the plunge tunnel on a wall of the gate road.

11. A system as claimed in claim 1, wherein the ram is coupled with the coupler to a centre of the continuous miner arrangement, or the at least one ram including a pair of rams for mounting to either side of the continuous miner arrangement.

12. A system as claimed in claim 1, wherein the pulling apparatus is temporarily set up to recover the stuck continuous miner arrangement, and is not used in forming the plunge tunnel.

13. A system as claimed in claim 1, wherein the pulling apparatus is coupled to and pulls an endmost conveyor module of the flexible conveyor system.

14. A method for recovering a stuck continuous miner arrangement from a plunge tunnel extending in a first direction, the plunge tunnel formed from a gate road extending in a second direction, the continuous miner arrangement including a continuous miner and a flexible conveyor system with articulating conveyor modules coupled to the continuous miner, the articulating conveyor modules extending in the first and second directions when forming the plunge tunnel, the method involving:

assembling a support assembly outside the plunge tunnel in the gate road for supporting a pulling apparatus;

coupling the stuck continuous miner arrangement to the pulling apparatus; and pulling, by retracting the pulling apparatus, the flexible conveyor system of the stuck continuous miner arrangement from the plunge tunnel, either fully or partially, until the continuous miner arrangement can once again retract from the plunge tunnel under its own power.

15. A method as claimed in claim 14, further involving providing guides extending in the second direction to guide the continuous miner arrangement along a path.

16. A method as claimed in claim 14, further involving decoupling one or more conveyor modules from the continuous miner arrangement, prior to the pulling.

17. A method as claimed in claim 14, further involving pulling and then removing a rearmost conveyor of the continuous miner arrangement, before repeating so that the continuous miner arrangement is serially removed.

* * * * *